US012796797B2

(12) United States Patent
Jung et al.

(10) Patent No.: US 12,796,797 B2
(45) Date of Patent: Nov. 17, 2026

(54) COSMETIC CONTAINER HAVING AUTOMATIC DROPPER

(71) Applicant: SHIN WOO CO., LTD., Uiwang-si (KR)

(72) Inventors: Shin Bok Jung, Incheon (KR); Seung Ho Baek, Anyang-si (KR); Seong Wan Hong, Suwon-si (KR)

(73) Assignee: SHIN WOO CO., LTD., Uiwang-si (KR)

( * ) Notice: Subject to any disclaimer, the term of this patent is extended or adjusted under 35 U.S.C. 154(b) by 265 days.

(21) Appl. No.: 18/287,349

(22) PCT Filed: Jul. 20, 2021

(86) PCT No.: PCT/KR2021/009332
§ 371 (c)(1),
(2) Date: Nov. 9, 2023

(87) PCT Pub. No.: WO2022/225098
PCT Pub. Date: Oct. 27, 2022

(65) Prior Publication Data

US 2024/0206617 A1 Jun. 27, 2024

(30) Foreign Application Priority Data

Apr. 21, 2021 (KR) ..... 10-2021-0051990

(51) Int. Cl.
*A45D 34/04* (2006.01)
*B65D 47/18* (2006.01)

(52) U.S. Cl.
CPC ..... *A45D 34/04* (2013.01); *B65D 47/18* (2013.01); *A45D 2200/056* (2013.01)

(58) Field of Classification Search
CPC .... A45D 34/04; A45D 200/056; B65D 47/18; B01L 3/0282; B01L 3/0272
USPC ..... 222/420
See application file for complete search history.

(56) References Cited

U.S. PATENT DOCUMENTS 4,573,503 A * 3/1986 Bruhn ..... G01F 11/084 422/934
2015/0232240 A1* 8/2015 Lee ..... A45D 34/04 220/288
2016/0150867 A1* 6/2016 Lee ..... B05B 11/043 222/209

FOREIGN PATENT DOCUMENTS

KR 10-1202092 B1 11/2012
KR 10-1465886 B1 11/2014
KR 10-1500601 B1 3/2015
KR 10-1780903 B1 9/2017
KR 10-2017-0139290 A 12/2017

* cited by examiner

*Primary Examiner* — David P Angwin
(74) *Attorney, Agent, or Firm* — Bridgeway IP Law Group, PLLC; Jihun Kim

(57) ABSTRACT

Proposed is a cosmetic container having an automatic dropper that enables a cosmetic product to be automatically filled in a dropper tube. In the present disclosure, since a filling inducing part is changed such that an internal volume of the filling inducing part is increased during a process of opening a cap part after the cap part is closed, there is an effect that the cosmetic product in the container main body is automatically filled into the dropper tube without the user having to press the head separately.

6 Claims, 11 Drawing Sheets

COSMETIC CONTAINER HAVING AUTOMATIC DROPPER

TECHNICAL FIELD

The present disclosure relates to a cosmetic container having an automatic dropper. More particularly, the present disclosure relates to a cosmetic container having an automatic dropper that enables a dropper tube to be automatically filled with a cosmetic product.

BACKGROUND ART

As women's economic activities increase and women's purchasing power increases, the demand for a functional cosmetic product for maintaining youth, preventing aging due to environmental pollution, reducing wrinkles, and blocking ultraviolet rays is increasing. Such a functional cosmetic product is significantly vulnerable to external contamination. Therefore, when the contents of the cosmetic product are used by applying the contents by hand like a general cream-type cosmetic product or when the contents of a cosmetic product such as a lotion are discharged by having an opening part of a cosmetic container touch the palm of the hand, there is a risk that contaminants from the hand may be introduced into the cosmetic container body, and the contents of the cosmetic product may deteriorate.

Accordingly, some functional cosmetic products are provided in a dropper-type cosmetic container, and are configured so that contents can be extracted by using a dropper. In the dropper-type cosmetic container, the dropper-type cosmetic container is capable of preventing a deterioration of the cosmetic product during the process of extracting a cosmetic product, and is capable of extracting a fixed amount of the contents, so that the dropper-type cosmetic container is capable of accurately supplying a fixed amount of contents to an area to which the contents will be applied and the contents of the cosmetic product are not wasted.

FIG. 1 is a view illustrating a conventional dropper-type cosmetic container. Referring to FIG. 1, the conventional dropper-type cosmetic container includes a container main body 11 in which a cosmetic product is contained, a cap part 12 capable of opening and closing an opening part of the container main body 11, a pressing part 13 having an elastic material, the pressing part 13 being provided on an upper portion of the cap part 12 and being configured to generate a change in pressure, and a dropper tube 14 formed such that the dropper tube 14 extends downward to the pressing part 13, the dropper tube 14 being configured to suction and discharge the cosmetic product contained inside the container main body 11.

In such a conventional dropper-type cosmetic container, when the conventional dropper-type cosmetic container is used, the conventional dropper-type cosmetic container is required to be used by separating the cap part 12 from the container main body 11 after the pressing part 13 is pressed while the dropper tube 14 is in a state in which the dropper tube 14 is immersed in the cosmetic product in the container main body 11. As such, in the conventional technology, a user is required to press the pressing part 13 every time the user uses the cosmetic container, so that there is a problem that the use of the conventional technology is cumbersome.

DISCLOSURE

Technical Problem

Accordingly, the present disclosure has been made keeping in mind the above problems occurring in the related art, and an objective of the present disclosure is to provide a cosmetic container having an automatic dropper capable of automatically filling a cosmetic product into a dropper tube.

Technical Solution

In order to achieve the objective described above, there is provided a cosmetic container having an automatic dropper, the cosmetic container including: a container main body in which a cosmetic product is contained; a cap part mounted on an upper side of the container main body; a pressing part having an elastic material, the pressing part being provided on the cap part and being configured to generate a pressure change; and the automatic dropper having a dropper tube which extends to downward of the pressing part and which is configured to suction and discharge the cosmetic product contained inside the container main body, wherein the pressing part includes: a head formed such that the head protrudes on an upper portion of the cap part, the head having an inner portion thereof provided with an empty space; a filling inducing part having the elastic material, the filling inducing part extending downward on a lower side of the head and being positioned inside the cap part; and a connection part which is positioned at a lower portion of the filling inducing part and to which the dropper tube is connected, a lower side of the filling inducing part or the connection part is supported on the container main body, and an internal volume of the filling inducing part is changed as a shape of the filling inducing part is changed according to a separation distance between the head and the connection part due to an upward movement and a downward movement of the cap part.

In addition, the cap part may include a head connection part to which a lower outer circumference of the head is coupled, and may include a body connection part which extends from a lower portion of the head connection part such that the body connection part is mounted on the upper side of the container main body. The container main body may include an insertion part inserted into the body connection part, and may include a receiving part that extends to a lower portion of the insertion part. In a state in which the insertion part is inserted into the body connection part, when the body connection part is moved downward along the insertion part, the head may be positioned so that the head is moved close to the connection part, so that the filling inducing part may be changed such that the internal volume of the filling inducing part is reduced. In a state in which the body connection part is moved downward along the insertion part, when the body connection part is moved upward along the insertion part, the head may be positioned so that the head is moved away from the connection part, so that the filling inducing part may be changed such that the internal volume of the filling inducing part is increased, thereby allowing the cosmetic product contained in the container main body to be suctioned in a direction of the filling inducing part through the dropper tube.

In addition, a cap thread may be formed on an inner circumference of the body connection part, and a body thread may be formed on an outer circumference of the insertion part such that the body thread is capable of being screw-coupled to the cap thread. When the cap thread and the body thread are screw-coupled to each other by rotating the body connection part in a forward direction, the head may be moved downward so that the head is moved close to the connection part. When screw-coupling between the cap thread and the body thread is released by rotating the cap part in a reverse direction, the head may be moved upward so that the head is moved away from the connection part.

In addition, a fitting coupling part may be formed on an inner circumference of the head connection part, an upper fitting part may be formed on the lower outer circumference of the head such that the upper fitting part is fitted and coupled to the fitting coupling part, and when the body connection part is moved upward along the insertion part, the head connection part may move the lower side of the head upward.

In addition, the filling inducing part may be formed in a hollow column shape, and a first side thereof may be connected to the head and a second side thereof may be connected to the connection part. An outer side between the first side and the second side of the filling inducing part may be formed such that a plurality of convex parts and a plurality of concave parts are alternately and repeatedly arranged in an upright state, and the convex parts and the concave parts may be formed such that the convex parts and the concave parts are bent in spiral shapes along a direction in which the body connection part is rotated forward. When the head is moved downward so that the head is moved close to the connection part as the body connection part is rotated forward, the convex parts and the concave parts may be elastically deformed so that bent angles of the convex parts and the concave parts are gradually decreased. When the bent angles of the convex parts and the concave parts are gradually increased and restored as the body connection part is rotated in the reverse direction, the head may be moved upward so that the head is moved away from the connection part, and the filling inducing part may be changed such that the internal volume of the filling inducing part is increased.

In addition, the filling inducing part may be formed in a hollow column shape, a first side thereof may be connected to the head and a second side thereof may be connected to the connection part, and an outer side between the first side and the second side of the filling inducing part may be formed such that a plurality of convex parts and a plurality of concave parts are alternately stacked and repeatedly arranged in up and down directions. The convex parts may be elastically deformed such that a gap between a pair of the convex parts adjacent to each other is gradually reduced when the head is moved downward so that the head is moved close to the connection part as the body connection part is rotated forward. Furthermore, the head may be moved upward so that the head is moved away from the connection part and the filling inducing part may be changed so that the internal volume of the filling inducing part is increased when the gap between the pair of the convex parts adjacent to each other is increased and restored as the body connection part is rotated in the reverse direction.

Advantageous Effects

In the present disclosure, since the filling inducing part is changed such that the internal volume of the filling inducing part is increased during the process of opening the cap part after the cap part is closed, there is an effect that the cosmetic product in the container main body is automatically filled into the dropper tube without the user having to press the head separately.

In addition, since the head is configured such that the head is physically coupled to the head connection part, the head connection part moves the lower side of the head upward when the body connection part is moved upward along the insertion part, so that the filling inducing part is induced such that the increasing amount of the internal volume of the filling inducing part is always constant. Therefore, there is an effect that the amount of cosmetic product that is suctioned toward the filling inducing part through the dropper tube is always constant.

In addition, since the filling inducing part is formed in the simple structure, there is an effect that the unit price may be lowered by reducing the manufacturing cost.

In addition, since the convex part and the concave part of the filling inducing part are formed such that the convex part and the concave part are bent in the spiral shapes along the direction in which the cap part is rotated in the forward direction, there is an effect that the bent angles of the convex part and the concave part are easily decreased when the body connection part presses the upper side of the filling inducing part downward.

In addition, since the convex part and the concave part of the filling inducing part are formed in a zig-zag shape in the up and down directions, there is an effect that the convex parts are elastically deformed so that the gap between the pair of the convex parts adjacent to each other is easily reduced when the body connection part presses the upper side of the filling inducing part downward.

<DESCRIPTION OF MAIN REFERENCE NUMERALS OF DRAWINGS>

| | |
|---|---|
| 1000: cosmetic container | |
| 100: container main body | |
| 110. receiving part | 120: insertion part |
| 122: body thread | 130: wiper |
| 200: automatic dropper | |
| 210: cap part | 212: head connection part |
| 213: fitting coupling part | 214: body connection part |
| 216: cap thread | 220: pressing part |
| 222: head | 223: upper fitting part |
| 224: filling inducing part | 224a: convex part |
| 224b: concave part | 225: filling inducing part |
| 225a: convex part | 225b: concave part |
| 226: connection part | 227: lower fitting part |
| 228: support part | 230: dropper tube |

MODE FOR INVENTION

Hereinafter, a cosmetic container having an automatic dropper according to an exemplary embodiment of the present disclosure will be described in more detail with reference to the accompanying drawings.

Figure 1:
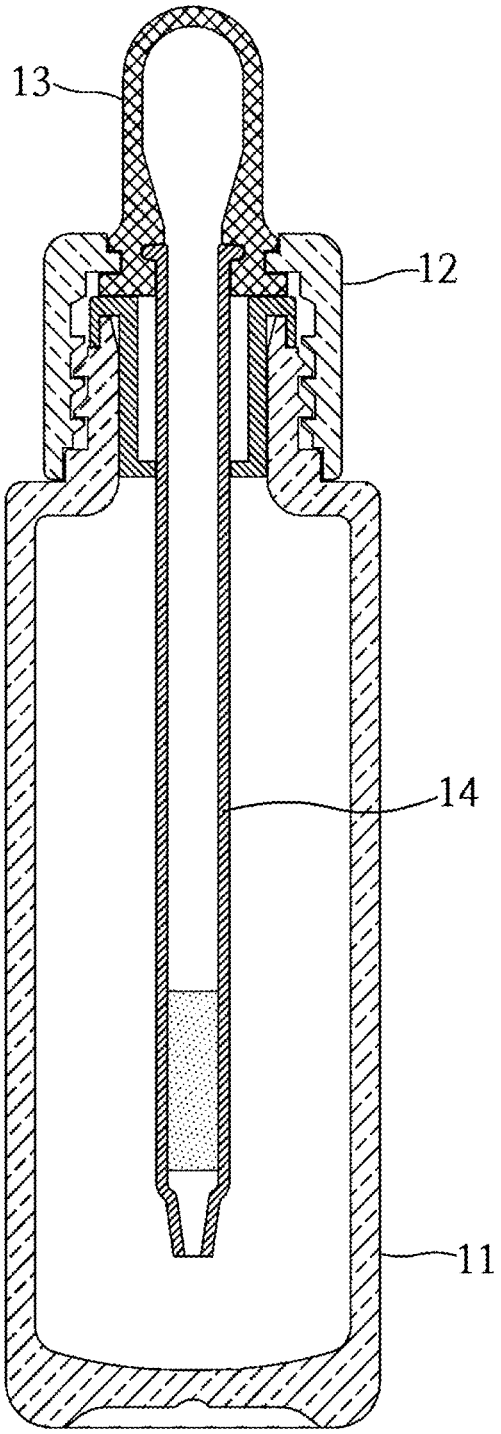
FIG. 1 is a view illustrating a conventional dropper-type cosmetic container.
Figure 2:
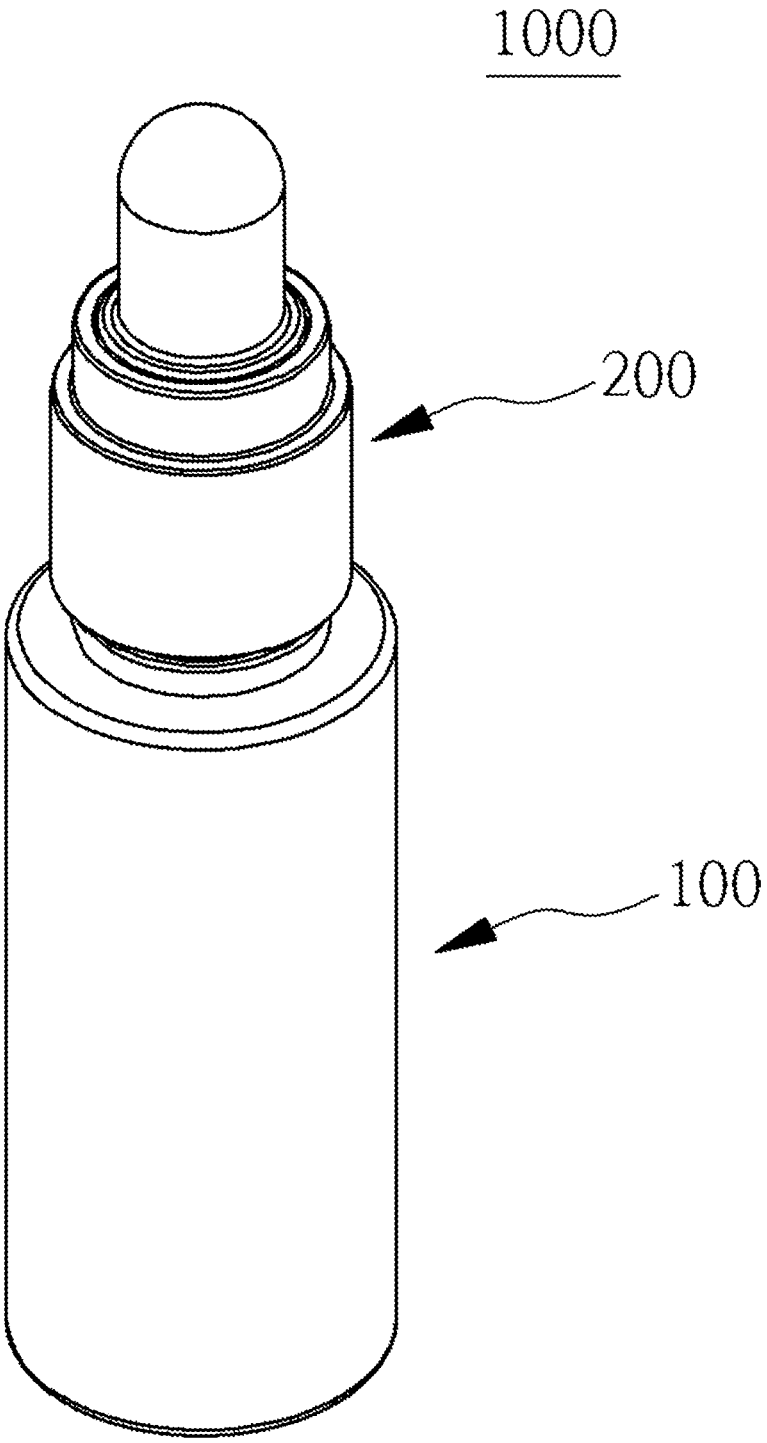
FIG. 2 is a view schematically illustrating a cosmetic container having an automatic dropper according to an exemplary first embodiment of the present disclosure.
Figure 3:
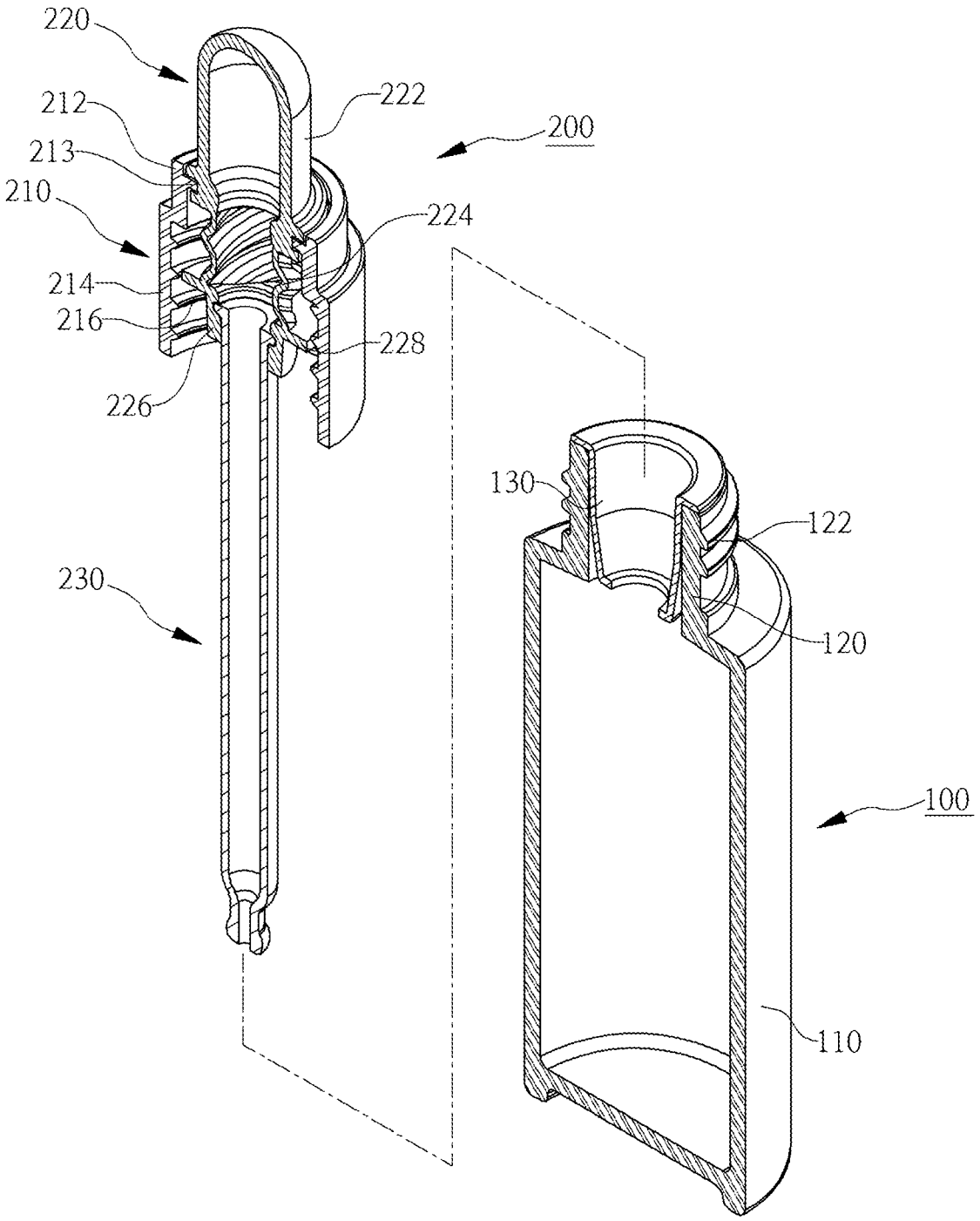
FIG. 3 is a view illustrating a state in which the cosmetic container having the automatic dropper according to the exemplary first embodiment of the present disclosure is disassembled.

FIG. 2 is a view illustrating a cosmetic container having an automatic dropper according to an exemplary first embodiment of the present disclosure, and FIG. 3 is a view illustrating a state in which the cosmetic container having the automatic dropper according to the exemplary first embodiment of the present disclosure is disassembled.

Referring to FIG. 2 and FIG. 3, for example, a cosmetic container 1000 provided with an automatic dropper 200 according to an exemplary first embodiment of the present disclosure is applied to a dropper-type cosmetic container, and includes a container main body 100 and the automatic dropper 200.

The container main body 100 includes a receiving part 110 which is formed in a long shape along a longitudinal direction and which has a space formed so that a liquid cosmetic product is accommodated therein, and includes an insertion part 120 that extends upward along an open upper portion of the receiving part 110. The insertion part 120 is formed such that the insertion part 120 has a diameter smaller than a diameter of the receiving part 110. For example, the receiving part 110 is formed of a transparent material or a translucent material, so that a user may easily check the remaining amount of a cosmetic product contained in the receiving part 110. The cosmetic product contained in the receiving part 110 may be a liquid functional cosmetic product. In an outer circumference of the insertion part 120, a body thread 122 is formed such that a cap thread 216 and the body thread 120 are capable of being screw-coupled to each other. For example, such a container main body 100 may be formed of glass, plastic, or the like.

In addition, a wiper 130 may be mounted on an inner circumference of the insertion part 120. The wiper 130 pushes contents smeared on an outer side of a dropper tube 230 that will be described later, and may be formed of a soft material or an elastic material. Such a wiper 130 is a conventional configuration and the description of the wiper 130 may be omitted. The automatic dropper 200 is for dropping a cosmetic product contained in the receiving part 110 to the outside after the automatic dropper 200 performs suctioning of the cosmetic product, and includes a cap part 210, a pressing part 220, and the dropper tube 230.

The cap part 210 includes a body connection part 214 formed such that the body connection part 214 surrounds the outer circumference of the insertion part 120, and includes a head connection part 212 that extends upward to an upper portion of the body connection part 214. The cap thread 216 is formed on an inner circumference of the body connection part 214. Therefore, when the body connection part 214 is mounted such that the body connection part 214 is inserted into the insertion part 120, the body thread 122 and the cap thread 216 are screw-coupled to each other. The pressing part 220 and the dropper tube 230 will be described later.

Figure 4:
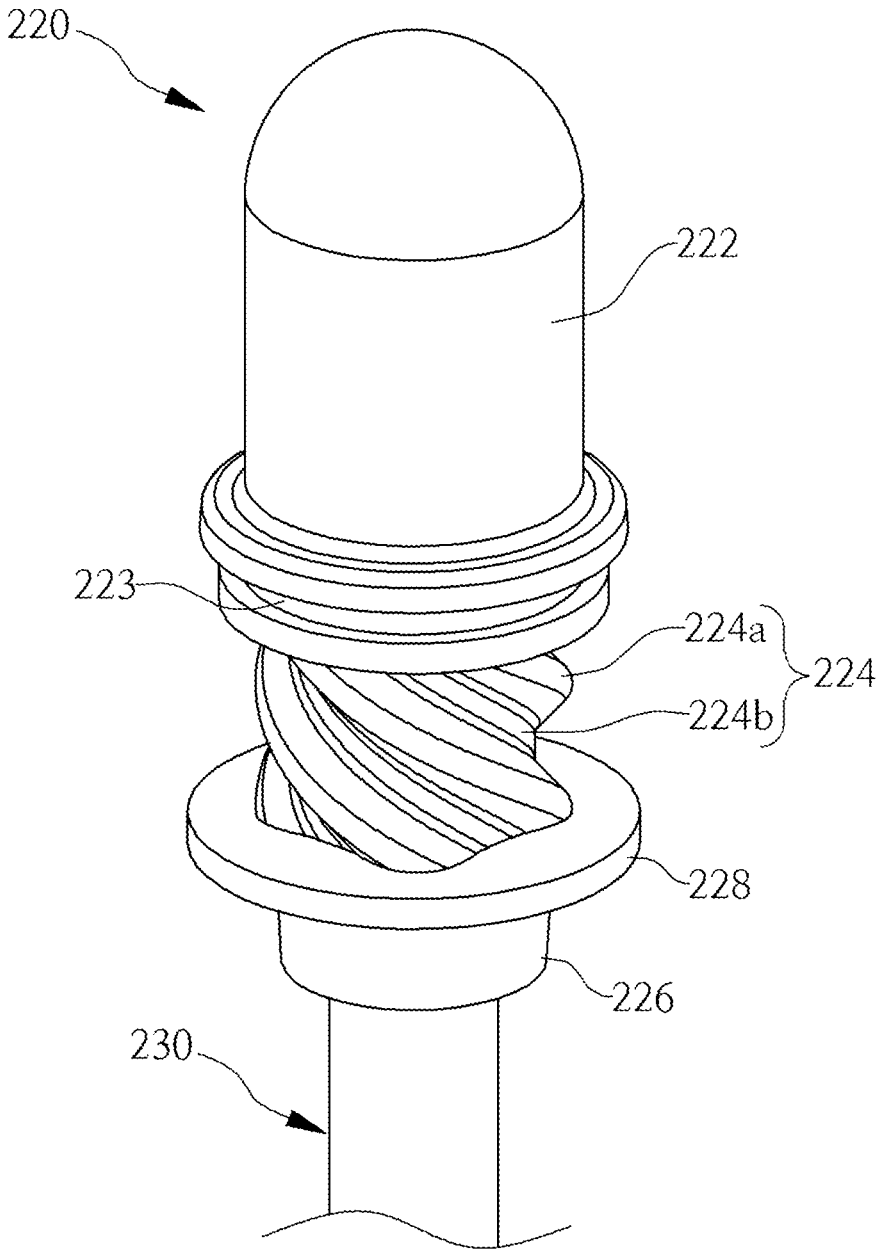
FIG. 4 is a view illustrating a pressing part and a dropper tube of the cosmetic container having the automatic dropper according to the exemplary first embodiment of the present disclosure.
Figure 5:
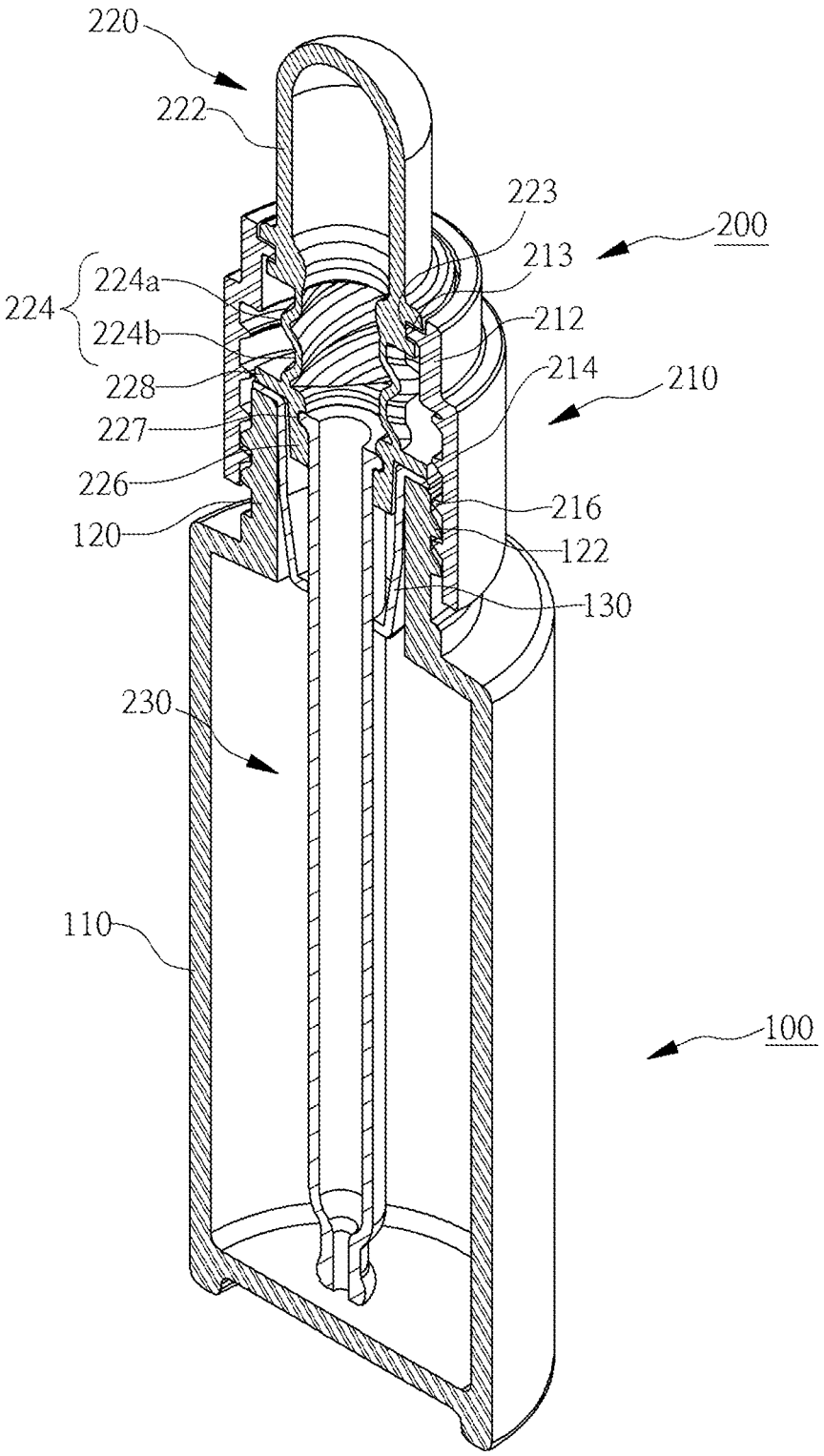
FIG. 5 is a view illustrating a cross-sectional area of the cosmetic container having the automatic dropper according to the exemplary first embodiment of the present disclosure.

FIG. 4 is a view illustrating a pressing part and a dropper tube of the cosmetic container having the automatic dropper according to the exemplary first embodiment of the present disclosure, and FIG. 5 is a view illustrating a cross-sectional area of the cosmetic container having an automatic dropper according to the exemplary first embodiment of the present disclosure.

Referring to FIGS. 2 to 5, the pressing part 220 includes a head 222 which protrudes on the upper portion of the cap part 210 and which has an empty space therein, a filling inducing part 224 which extends downward on a lower side of the head 222 and which has an elastic material and is positioned inside the cap part 210, and a connection part 226 which is positioned at a lower portion of the filling inducing part 224 and to which the dropper tube 230 that will be described later is connected.

The head 222 and the filling inducing part 224 are formed of an elastic material so that the head 222 and the filling inducing part 224 have a restorative force, and may be formed as an integral part. The connection part 226 may be formed integrally on the lower portion of the filling inducing part 224. In addition, the head connection part 212 is fitted and coupled to an upper fitting part 223 that is formed between the head 222 and the filling inducing part 224, and an upper portion of the dropper tube 230 is fitted and coupled to a lower fitting part 227 that is formed on an inner circumference of the connection part 226. At this time, a fitting coupling part 213 having a concave shape is formed along an inner circumference of the head connection part 212, and the upper fitting part 223 protrudes on a lower outer circumference of the head 222 so that the upper fitting part 223 is fitted and coupled to the fitting coupling part 213. As such, since the upper fitting part 223 is physically fitted and coupled to the fitting coupling part 213, the head 222 and the head connection part 213 are solidly coupled to each other. Meanwhile, the upper fitting part 223 may be coupled such that the upper fitting part 223 is capable of being rotated while the upper fitting part 223 is caught to the fitting coupling part 213.

The connection part 226 is inserted into an upper portion of the wiper 130. In addition, the lower side of the filling inducing part 224 or the connection part 226 is supported on the container main body 100. To this end, for example, a support part 228 protrudes along an upper outer circumference of the connection part 226. In addition, the support part 228 is seated on the upper portion of the insertion part 120 of the container main body 100.

The filling inducing part 224 is formed in a hollow column shape, and is formed of a flexible material. Such a filling inducing part 224 has a first side connected to the head 222 and has a second side connected to the connection part 226, and an outer side of the filling inducing part 224 between the first side and the second side is formed such that a plurality of convex parts 224*a* and a plurality of concave parts 244*b* are alternately and repeatedly arranged in an upright state. The convex part 224*a* may be formed convex in an external direction of the filling inducing part 224, and the concave part 224*b* may be formed concave in an internal direction of the filling inducing part 224. At this time, the convex part 224*a* and the concave part 224*b* are formed such that the convex part 224*a* and the concave part 224*b* are bent in spiral shapes along a direction in which the cap part 210 is rotated in a forward direction. In addition, when the cap part 210 is moved up and down according to the forward or reverse rotation of the cap part 210 inserted into the insertion part 120, a separation distance between the head 222 and the connection part 226 is changed. At this time, a shape of the filling inducing part 224 is changed, so that an internal volume of the filling inducing part 224 is changed. Since the filling inducing part 224 is formed in a simple structure, there is an effect that the unit price may be lowered by reducing the manufacturing cost.

For example, the dropper tube 230 is formed of glass, synthetic resin, or the like. Furthermore, an upper side of the dropper tube 230 is fitted and coupled to the lower fitting part 227, and a lower side of the dropper tube 230 extends toward a lower side of the connection part 226 and is positioned in the receiving part 110 of the container main body 100. In addition, when an internal volume of the head 222 is changed due to an external pressure applied to the head 222, a pressure change occurs according to the internal volume change of the head 222, so that the cosmetic product contained in the receiving part 110 is introduced into the head 222 along the dropper tube 230, or the cosmetic product introduced into the dropper tube 230 is discharged downward.

Hereinafter, an action of the cosmetic container having the automatic dropper according to the exemplary first embodiment of the present disclosure will be described.

Figure 6:
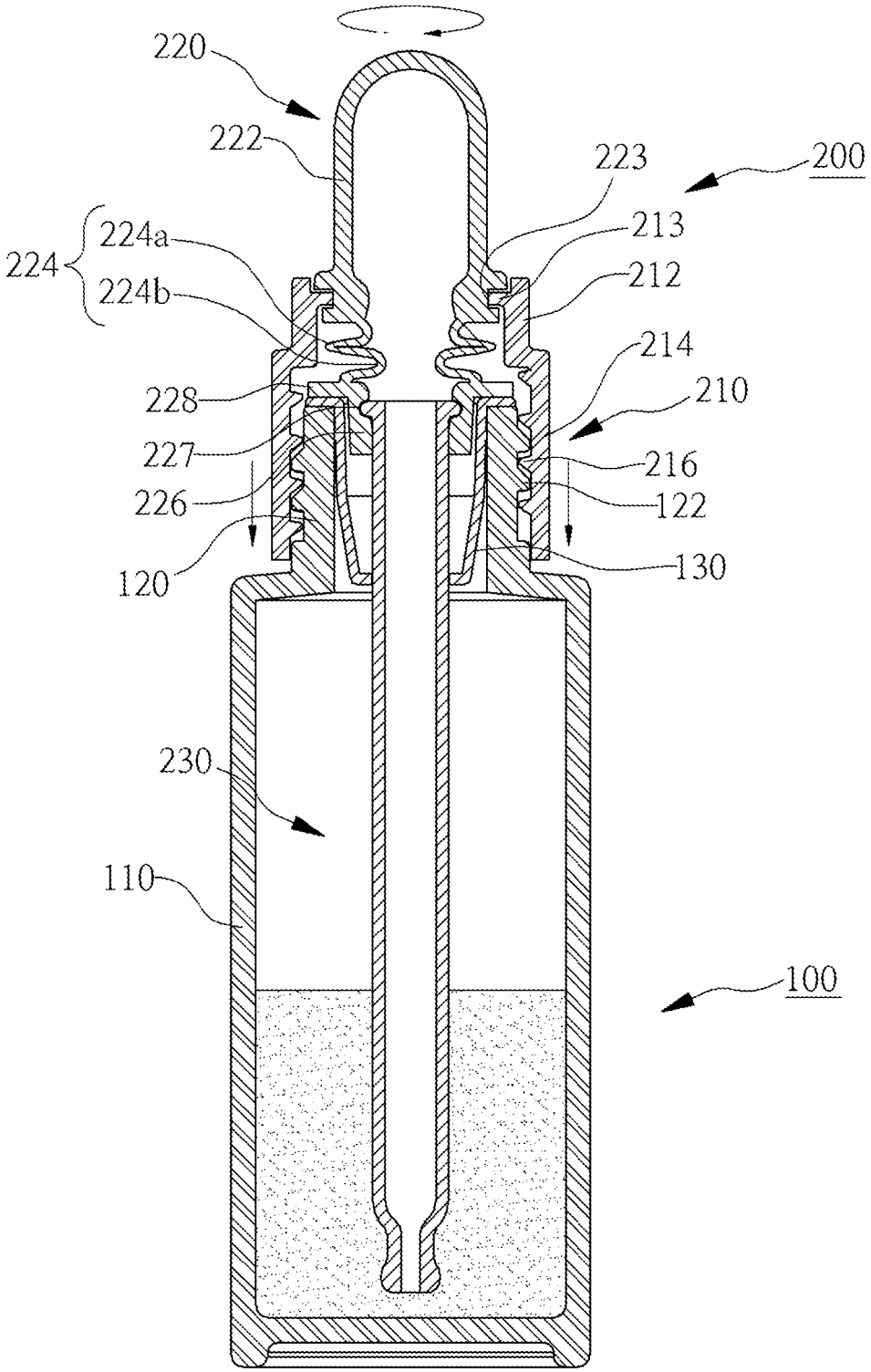
FIG. 6 is a view illustrating a state in which a cap part of the cosmetic container having the automatic dropper according to the exemplary first embodiment of the present disclosure is coupled to a container main body.

FIG. 6 is a view illustrating a state in which a cap part of the cosmetic container having the automatic dropper according to the exemplary first embodiment of the present disclosure is coupled to a container main body.

Referring to FIG. 6, in a state in which the body connection part 214 is inserted into the insertion part 120, the body connection part 214 of the cap part 210 is rotated forward so as to close the cap part 210. Then, as cap thread 216 and the body thread 122 are screw-coupled together, the body connection part 214 is moved downward. In addition, the head 222 connected to the body connection part 214 is moved downward so that the head 222 is moved close to the connection part 226, but the support part 228 is supported on the insertion part 120 so that the head 22 is not possible to be further moved downward, so that a height of the filling inducing part 224 between the head 222 and the support part 228 is reduced. At this time, the convex part 224*a* and the concave part 224*b* are further bent in the spiral shapes along the direction in which the cap part 210 is rotated in the forward direction, and the convex part 224*a* and the concave part 224*b* are elastically deformed such that bent angles of the convex part 224*a* and the concave part 224*b* are gradually decreased. Accordingly, the upper side of the filling inducing part 224 is moved downward in a downward direction. Then, the filling inducing part 224 is changed such that the internal volume of the filling inducing part 224 is reduced.

As such, since the convex part 224*a* and the concave part 224*b* of the filling inducing part 224 are formed such that the convex part 224*a* and the concave part 224*b* are bent in the spiral shapes along the direction in which the cap part 210 is rotated in the forward direction, there is an effect that the convex part 224*a* and the concave part 224*b* are elastically deformed so that the bent angles of the convex part 224*a* and the concave part 224*b* are easily decreased when the body connection part 214 presses the upper side of the filling inducing part 224 downward.

In addition, since the upper fitting part 223 of the head 222 is in a state in which the upper fitting part 223 is fitted and coupled to the fitting coupling part 213 of the head connection part 212, the cap part 222 is moved downward along the head connection part 212 when the body connection part 214 is moved downward by a predetermined length. Therefore, the height of the filling inducing part 224 is accurately lowered by a predetermined height, so that there is an effect that the internal volume of the filling inducing part 224 that is reduced is always constant.

Figure 7:
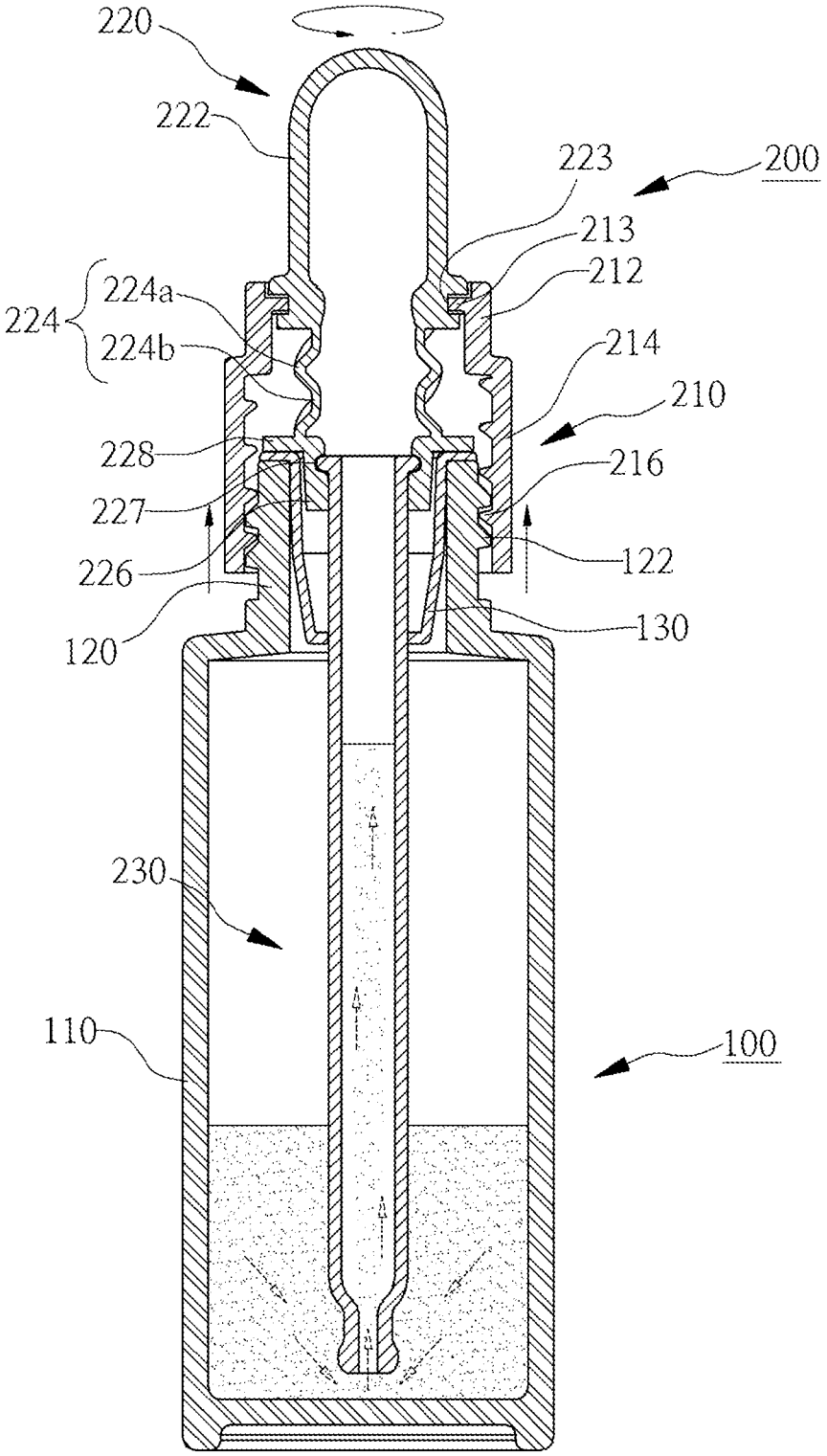
FIG. 7 is a view illustrating a state in which the cap part of the cosmetic container having the automatic dropper according to the exemplary first embodiment of the present disclosure is released from the container main body.

FIG. 7 is a view illustrating a state in which the cap part of the cosmetic container having the automatic dropper according to the exemplary first embodiment of the present disclosure is released from the container main body.

Referring to FIG. 7, when the cap part 210 is rotated in the reverse direction in order to open the cap part 210, the screw coupling of the cap thread 216 and the body thread 122 is released, and the body connection part 214 is moved upward, and also the head 222 connected to the body connection part 214 is moved upward such that the head 222 is moved away from the connection part 226. At this time, as the filling inducing part 224 connected to the head 222 is restored to an original state by the elastic force of the filling inducing part 224, the internal volume of the filling inducing part 224 is changed such that the internal volume of the filling inducing part 224 increases. That is, as the body connection part 214 is rotated in the reverse direction, the bent angles of the convex part 224*a* and the concave part 224*b* are gradually increased and restored, so that the head 222 is moved upward such that the head 222 is moved away from the connection part 226, and the filling inducing part 224 is changed so that the internal volume of the filling inducing part 224 increases. Then, the cosmetic product that is contained in the container main body 100 by the difference in the internal pressure of the filling inducing part 224 is automatically suctioned into the direction of the filling inducing part 224 through the dropper tube 230.

As such, in the present disclosure, since the internal volume of the filling inducing part 224 is changed such that the internal volume of the filling inducing part 224 increases during the process of opening the cap part 210 after the cap part 210 is closed, there is an effect that the cosmetic product in the container main body 100 is automatically filled into the dropper tube 230 without the user having to separately press the head 222.

In addition, since the upper fitting part 223 of the head 222 is in a state in which the upper fitting part 223 is fitted and coupled to the fitting coupling part 213 of the head connection part 212, the cap part 222 is moved upward along the head connection part 212 when the body connection part 214 is moved upward by the predetermined length as the cap part 210 is rotated in the reverse direction, so that the height of the filling inducing part 224 is accurately increased by the predetermined height. At this time, since the internal volume of the filling inducing part 224 is increased by the constant amount, the suctioned amount of cosmetic product suctioned through the dropper tube 230 toward the filing inducing part 224 is always constant, so that there is an effect that a constant quantity of the cosmetic product may be accurately supplied at all times.

Figure 8:
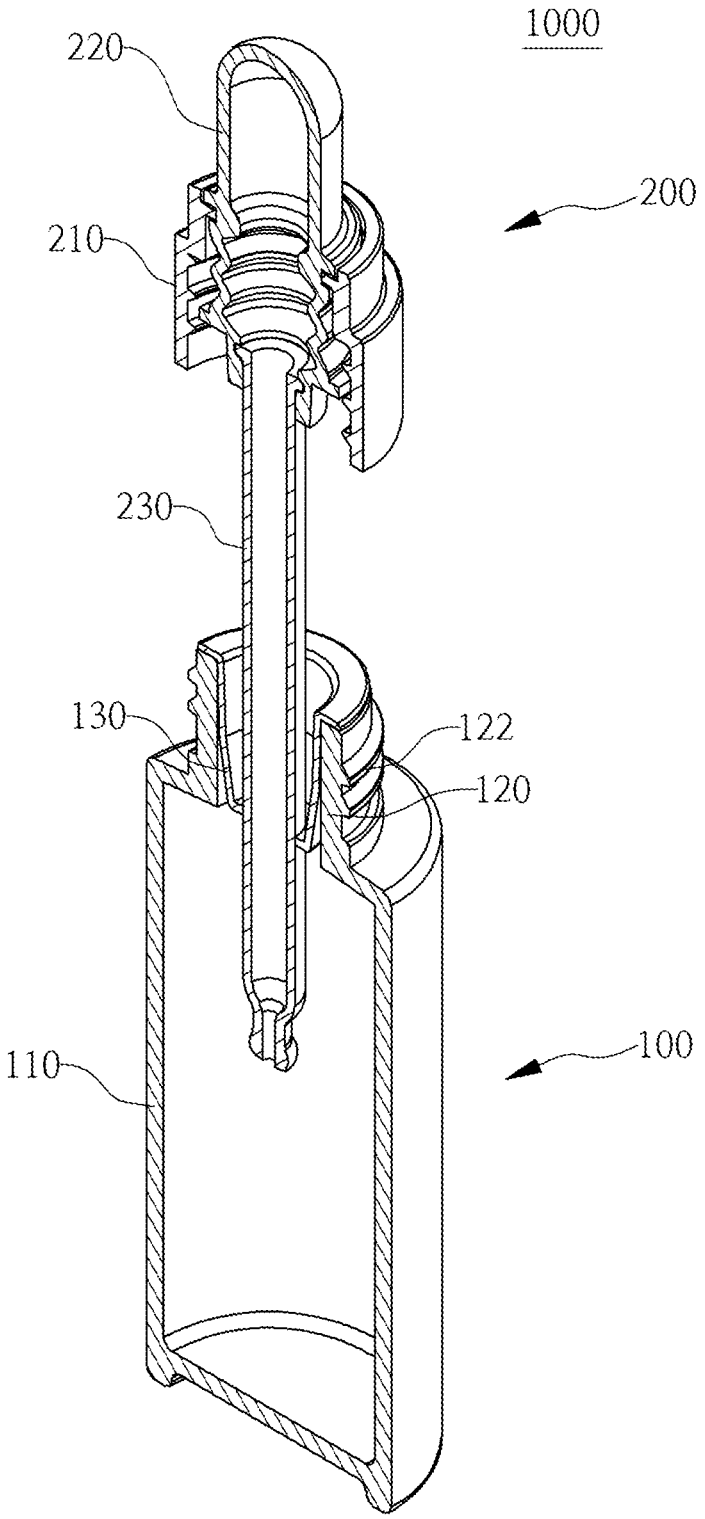
FIG. 8 is a view illustrating a state in which the cosmetic container having the automatic dropper according to an exemplary second embodiment of the present disclosure is disassembled.
Figure 9:
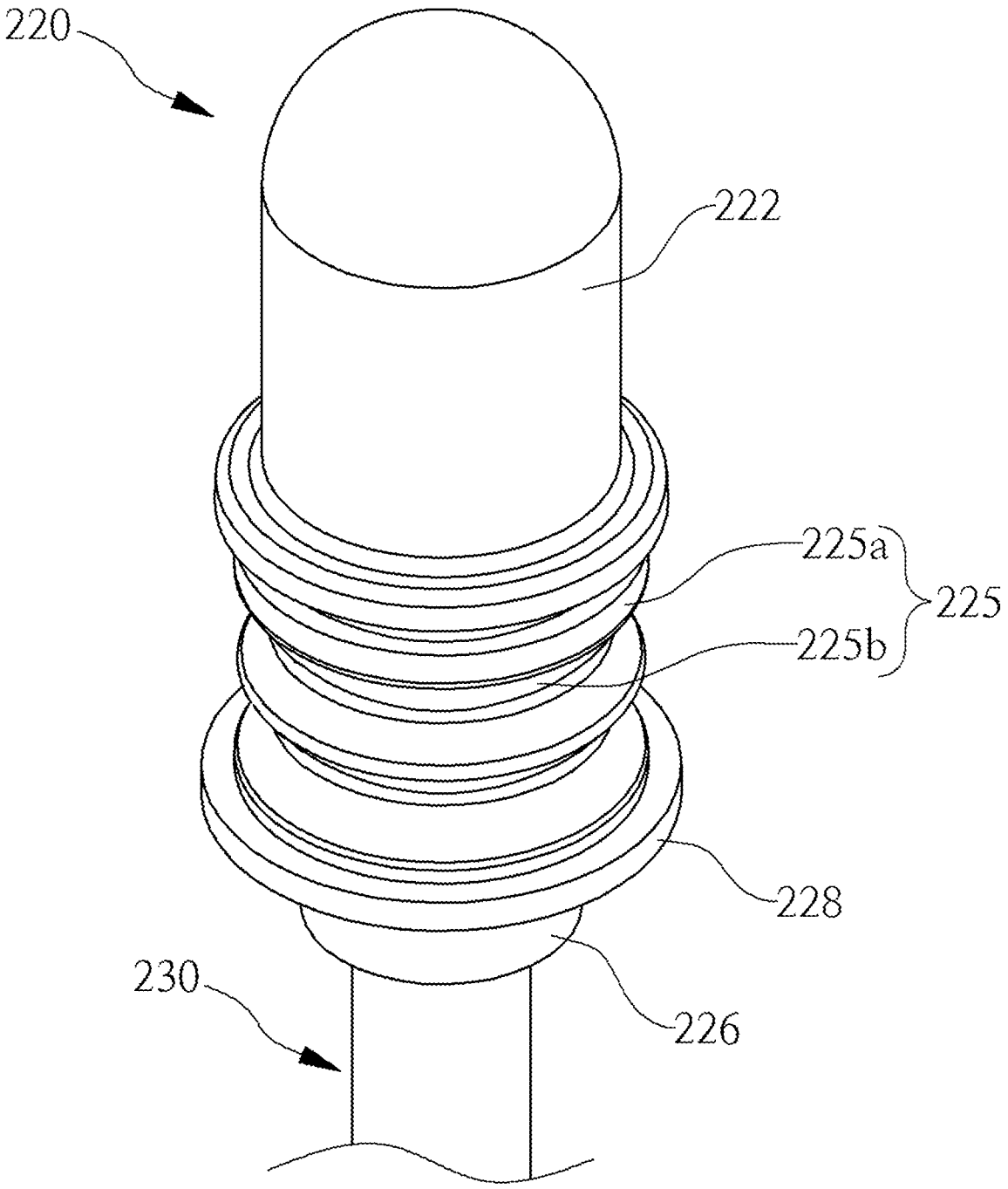
FIG. 9 is a view illustrating the pressing part and the dropper tube of the cosmetic container having the automatic dropper according to the exemplary second embodiment of the present disclosure.

FIG. 8 is a view illustrating a state in which the cosmetic container having the automatic dropper according to an exemplary second embodiment of the present disclosure is disassembled, and FIG. 9 is a view illustrating the pressing part and the dropper tube of the cosmetic container having the automatic dropper according to the exemplary second embodiment of the present disclosure.

Referring to FIG. 8 and FIG. 9, the cosmetic container 1000 having the automatic dropper 200 according to the exemplary second embodiment of the present disclosure includes the container main body 100 and the automatic dropper 200, but has a filling inducing part 225 provided in the automatic dropper 200, the filling inducing part 225 having a different configuration.

The filling inducing part 225 is formed in a hollow column shape, and a first side thereof is integrally connected to the head 222 and a second side thereof is integrally connected to the connection part 226. In addition, an outer side between the first side and the second side of the filling inducing part 225 is formed such that a plurality of convex parts 225*a* and a plurality of concave parts 225*b* are alternately stacked and repeatedly arranged in the up and down directions, so that the convex parts 225*a* and the concave parts 225*b* are repeated in a zig-zag shape in the up and down directions. The convex part 225*a* may be formed convex in an external direction of the filling inducing part 225, and the concave part 225*b* may be formed concave in an internal direction of the filling inducing part 225.

Hereinafter, an action of the cosmetic container having the automatic dropper 200 according to the exemplary second embodiment of the present disclosure will be described.

Figure 10:
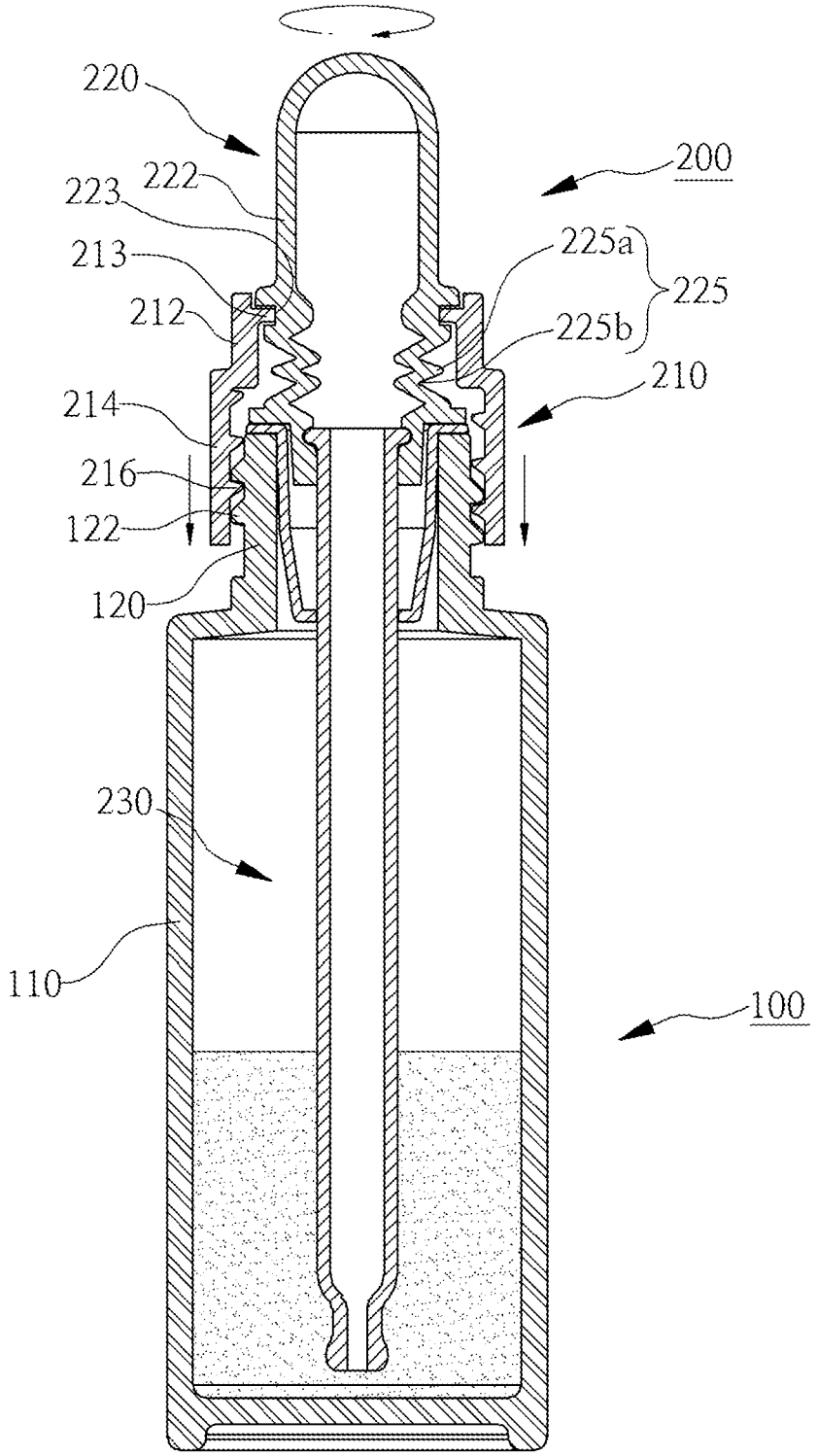
FIG. 10 is a view illustrating a state in which the cap part of the cosmetic container having the automatic dropper according to the exemplary second embodiment of the present disclosure is coupled to the container main body.

FIG. 10 is a view illustrating a state in which the cap part of the cosmetic container having the automatic dropper according to the exemplary second embodiment of the present disclosure is coupled to the container main body.

Referring to FIG. 9 and FIG. 10, when the body connection part 214 is inserted into the insertion part 120, the body connection part 214 of the cap part 210 is rotated forward so that the cap part 210 is closed. Then, as cap thread 216 and the body thread 122 are screw-coupled together, the body connection part 214 is moved downward. In addition, the head 222 connected to the body connection part 214 is moved downward so that the head 222 is moved close to the connection part 226, but the support part 228 is supported on the insertion part 120 so that the head 22 is not possible to be further moved downward, so that a height of the filling inducing part 225 between the head 222 and the support part 228 is reduced. At this time, elastic deformation occurs such that a gap between a pair of convex parts 225*a* adjacent to each other is gradually reduced, and accordingly, the upper side of the filling inducing part 225 is moved downward to the lower side of the filling inducing part 225. Then, the filling inducing part 225 is changed such that the internal volume of the filling inducing part 225 is reduced.

As such, since the convex part 225*a* and the concave part 225*b* of the filling inducing part 225 are formed in the zig-zag shape in the up and down directions, there is an effect that elastic deformation occurs so that the gap between the pair of convex parts 225*a* adjacent to each other is easily reduced when the body connection part 214 presses the upper side of the filling inducing part 225 downward.

Figure 11:
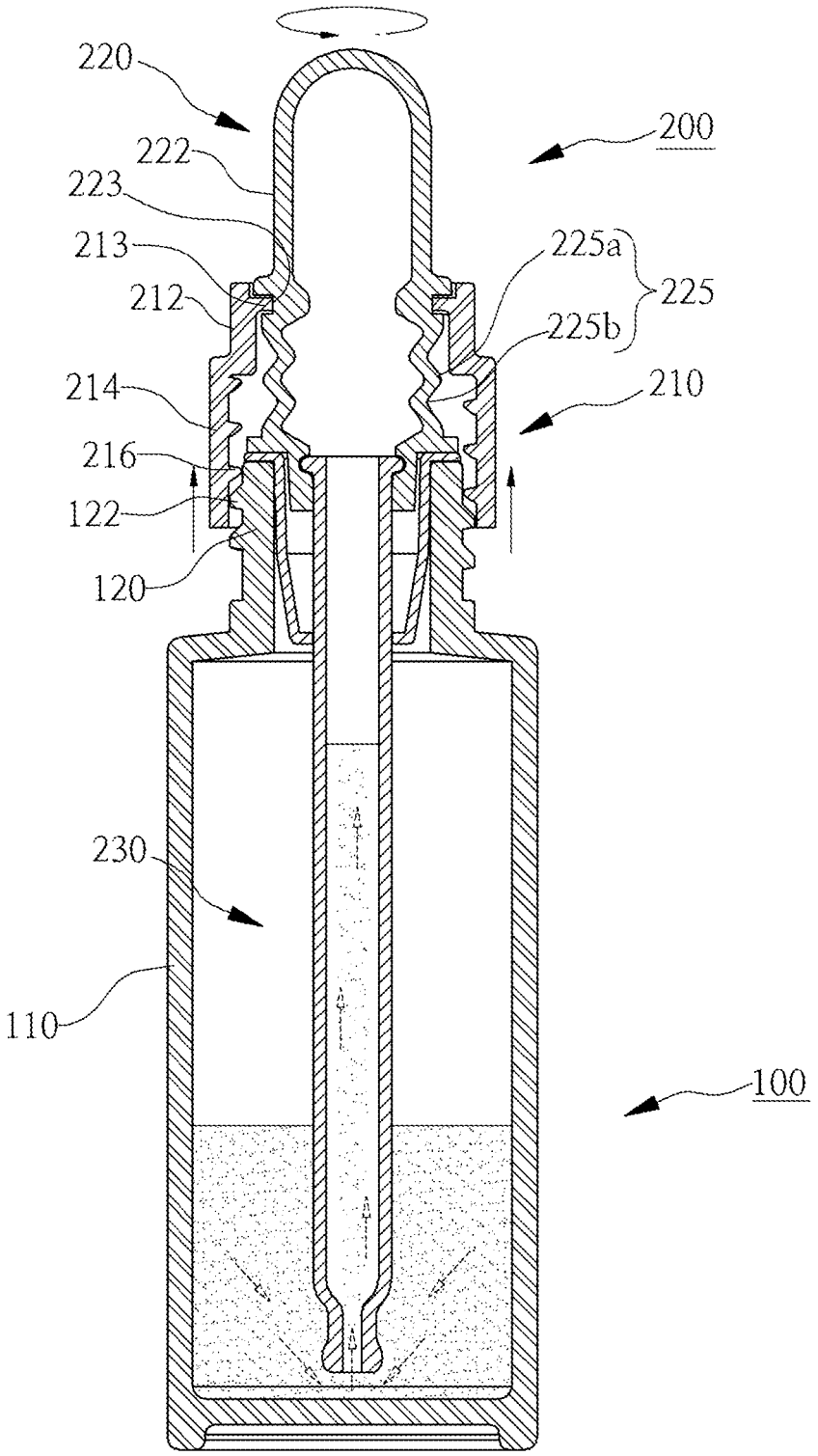
FIG. 11 is a view illustrating a state in which the cap part of the cosmetic container having the automatic dropper according to the exemplary second embodiment of the present disclosure is released from the container main body.

FIG. 11 is a view illustrating a state in which the cap part of the cosmetic container having the automatic dropper according to the exemplary second embodiment of the present disclosure is released from the container main body.

Referring to FIG. 11, when the cap part 210 is rotated in the reverse direction in order to open the cap part 210, the screw coupling of the cap thread 216 and the body thread 122 is released, and the body connection part 214 is moved upward, and also the head 222 connected to the body connection part 214 is moved upward such that the head 222 is moved away from the connection part 226. At this time, as the filling inducing part 225 connected to the head 222 is restored to an original state by the elastic force of the filling inducing part 225, the internal volume of the filling inducing part 225 is changed such that the internal volume of the filling inducing part 225 increases. That is, as the body connection part 214 is rotated in the reverse direction, the distance between the convex part 225*a* and the concave part 225*b* are gradually increased and restored, so that the head 222 is moved upward such that the head 222 is moved away from the connection part 226, and the filling inducing part 225 is changed so that the internal volume of the filling inducing part 225 increases. Then, the cosmetic product that is contained in the container main body 100 by the difference in the internal pressure of the filling inducing part 225 is automatically suctioned into the direction of the filling inducing part 225 through the dropper tube 230.

Although the present disclosure has been described in detail with the above embodiments, the present disclosure is not limited thereto, and it is apparent to those skilled in the art that various changes and modifications may be made within the scope of the technical spirit of the present disclosure, and if these variations and modifications are within the scope of the claims, the technical idea should also be regarded as belonging to the present disclosure.

The invention claimed is:

1. A cosmetic container, comprising:

a container main body configured to contain a cosmetic product;

a cap part configured to be mounted on an upper side of the container main body;

a pressing part comprising a first elastic material, the pressing part being disposed on the cap part and being configured to generate a pressure change; and a dropper tube extending from the pressing part, the dropper tube being configured to suction and discharge the cosmetic product, wherein the pressing part comprises:

a head protruding from an upper portion of the cap part, the head defining an internal empty space;

a filling inducing part comprising a second elastic material, the filling inducing part having a first end and a second end opposite to the first end, the filling inducing part being connected to the head at the first end, the filling inducing part extending from the first end to the second end, the filling inducing part being positioned inside the cap part; and a connection part connected to the second end of the filling inducing part and connected to the dropper tube, wherein at least one of a lower side of the filling inducing part and the connection part is configured to be supported on the container main body, and wherein the filling inducing part is configured to change an internal volume thereof as a shape of the filling inducing part is changed according to a separation distance between the head and the connection part due to an upward movement and a downward movement of the cap part, wherein the cap part includes a head connection part to which a lower outer circumference of the head is coupled, wherein the connection part includes a lower fitting part positioned on an inner circumference of the connection part, and an upper portion of the dropper tube is fitted and coupled to the lower fitting part, wherein the head connection part includes a fitting coupling part protruding along an inner circumference of the head connection part, wherein the head includes an upper fitting part having a groove extending along the lower outer circumference of the head, and wherein the fitting coupling part is rotatably coupled to and received in the upper fitting part such that the fitting coupling part is capable of being rotated while received in the upper fitting part, thereby enabling the cap part to rotate independently of the pressing part without transferring rotational motion to the filling inducing part, wherein the container main body includes a body thread defined on the upper side thereof, and the cap part includes a cap thread configured to be screw-coupled to the body thread, wherein an outer side of the filling inducing part includes a plurality of convex parts and a plurality of concave parts are alternately and repeatedly arranged, and wherein the plurality of convex parts and the plurality of concave parts are bent in a spiral shape along a direction of the body thread corresponding to a forward direction in which the cap part is to be rotated to be screw-coupled to the container main body.

2. The cosmetic container of claim 1, wherein the cap part further comprises a body connection part which extends from a lower portion of the head connection part such that the body connection part is configured to be mounted on the upper side of the container main body, wherein the container main body comprises:

an insertion part configured to be inserted into the body connection part; and a receiving part that extends from a lower portion of the insertion part, wherein, in a state in which the insertion part is inserted into the body connection part, when the body connection part is moved downward along the insertion part, the head is configured to be positioned so that the head is moved closer toward the connection part, so that the filling inducing part is changed such that the internal volume of the filling inducing part is reduced, and wherein in a state in which the body connection part is moved downward along the insertion part, when the body connection part is moved upward along the insertion part, the head is configured to be positioned so that the head is moved away from the connection part, so that the filling inducing part is changed such that the internal volume of the filling inducing part is increased, thereby allowing the cosmetic product contained in the container main body to be suctioned in a direction toward the filling inducing part through the dropper tube.

3. The cosmetic container of claim 2, wherein the cap thread is defined on an inner circumference of the body connection part, wherein the body thread is defined on an outer circumference of the insertion part, wherein when the cap thread and the body thread are screw-coupled to each other by rotating the body connection part in a forward direction, the head is configured to be moved downward so that the head is moved closer toward the connection part, and wherein when screw-coupling between the cap thread and the body thread is released by rotating the cap part in a direction reverse to the forward direction, the head is configured to be moved upward so that the head is moved away from the connection part.

4. The cosmetic container of claim 3, wherein when the body connection part is moved upward along the insertion part, the head connection part is configured to move the lower side of the head upward.

5. The cosmetic container of claim 3, wherein the filling inducing part has a hollow column shape, wherein when the head is moved downward so that the head is moved closer toward the connection part as the body connection part is rotated forward, the plurality of convex parts and the plurality of concave parts are configured to be elastically deformed so that bent angles of the plurality of convex parts and the plurality of concave parts are gradually decreased, and wherein when the bent angles of the plurality of convex parts and the plurality of concave parts are gradually increased and restored as the body connection part is rotated in the direction reverse to the forward direction, the head is configured to be moved upward so that the head is moved away from the connection part, and the filling inducing part is configured to be changed such that the internal volume of the filling inducing part is increased.

6. The cosmetic container of claim 3, wherein the filling inducing part has a hollow column shape, and an outer side of the filling inducing part between the first end and the second end of the filling inducing part is formed such that a plurality of convex parts and a plurality of concave parts are alternately stacked and repeatedly arranged in up and down directions, and wherein the plurality of convex parts are configured to be elastically deformed such that a gap between a pair of the convex parts adjacent to each other is gradually reduced when the head is moved downward so that the head is moved closer toward the connection part as the body connection part is rotated forward, and wherein the head is configured to be moved upward so that the head is moved away from the connection part and the filling inducing part is configured to be changed so that the internal volume of the filling inducing part is increased when the gap between the pair of the convex parts adjacent to each other is increased and restored as the body connection part is rotated in the direction reverse to the forward direction.

* * * * *